US009233573B2

(12) United States Patent
Yamanaka

(10) Patent No.: US 9,233,573 B2
(45) **Date of Patent: *Jan. 12, 2016**

(54) CONICAL NIB AND WRITING INSTRUMENT USING THE SAME

(71) Applicant: Shizuo Yamanaka, Tokyo (JP)

(72) Inventor: Shizuo Yamanaka, Tokyo (JP)

( * ) Notice: Subject to any disclaimer, the term of this patent is extended or adjusted under 35 U.S.C. 154(b) by 434 days.

This patent is subject to a terminal disclaimer.

(21) Appl. No.: 13/714,180

(22) Filed: Dec. 13, 2012

(65) Prior Publication Data

US 2013/0156488 A1 Jun. 20, 2013

(30) Foreign Application Priority Data

Dec. 15, 2011 (JP) ..... 2011-274220

(51) Int. Cl.

| | |
|---|---|
| ***B43K 1/00*** | (2006.01) |
| ***B43K 17/02*** | (2006.01) |
| ***B43K 8/00*** | (2006.01) |
| ***B43K 1/02*** | (2006.01) |

(52) U.S. Cl.

CPC . *B43K 1/003* (2013.01); *B43K 1/02* (2013.01); *B43K 8/00* (2013.01); *B43K 17/02* (2013.01)

(58) Field of Classification Search

CPC ..... B43K 1/003
USPC ..... 401/223, 292, 221, 231, 235, 137, 198, 401/233, 265, 258–260, 224
See application file for complete search history.

(56) References Cited

U.S. PATENT DOCUMENTS

| | | | | |
|---|---|---|---|---|
| 3,518,019 | A * | 6/1970 | Nakamura | 401/265 |
| 3,969,027 | A * | 7/1976 | Randar et al. | 401/199 |
| 4,986,684 | A * | 1/1991 | Yamanaka | 401/224 |
| 5,902,064 | A * | 5/1999 | Yamanaka | 401/292 |
| 5,957,610 | A * | 9/1999 | Yamanaka | 401/221 |
| 6,652,177 | B2 * | 11/2003 | Shimada et al. | 401/233 |
| 8,475,071 | B2 * | 7/2013 | Yamanaka | 401/235 |
| 8,801,314 | B2 * | 8/2014 | Yamanaka | 401/231 |

FOREIGN PATENT DOCUMENTS

| | | |
|---|---|---|
| JP | 2010-115786 | 5/2010 |

* cited by examiner

*Primary Examiner* — Mark A Laurenzi
*Assistant Examiner* — Thomas M Abebe
(74) *Attorney, Agent, or Firm* — Martin E. Hsia; Keri Ann Krzykowski

(57) ABSTRACT

A nib, among other parts which constitute a writing instrument, is made of a synthetic resin material in which engineering plastic is used. An ink supply wick includes a wick cover. An outer shape of a wick cover is determined such that it is attached to an outer periphery of the ink supply wick between the nib and the ink supply wick and is made to closely adhere to an inner periphery of the nib at least at the tip of the nib. A space between the nib and the ink supply wick is filled with the wick cover. The nib is made of a synthetic resin material in which engineering plastic is used. Therefore, the nib wear resistant and duration of the nib or the writing instrument can be extended.

6 Claims, 19 Drawing Sheets

CONICAL NIB AND WRITING INSTRUMENT USING THE SAME

BACKGROUND OF THE INVENTION

1. Field of the Invention

The present invention relates to a conical nib and a writing instrument using the same. More particularly, the invention relates to a wear-resistant conical nib and a writing instrument using the same.

2. Description of the Related Art

A writing instrument which includes such a kind of conical nib is disclosed in Japanese Unexamined Patent Application, First Publication No. H9-156279. In the disclosed writing instrument, the nib includes a nib base body and a converging member. The nib base body includes a cylindrical base portion and five to eight combtooth-shaped pieces. The combtooth-shaped pieces, each having a circular arc cross section, protrude from one end of the base portion in a continuous manner. The combtooth-shaped pieces are arranged at equal intervals around the circumference of a shaft with slit-shaped grooves formed therebetween. A hemispherical split portion is formed at tips of the combtooth-shaped pieces. The converging member is formed by a metal pipe which may fit onto an outer periphery of the nib base body. When the converging member is fit onto the nib base body, the combtooth-shaped pieces are tapered gradually toward the tips thereof to form a conical shape. A hemispherical writing tip is formed at the tips of the combtooth-shaped pieces and ink feed paths are formed between adjacent combtooth-shaped pieces. An ink supply wick having a capillary action to an end tip thereof is inserted in a hollow space inside the nib (i.e., the pen nib base body). The ink supply wick is fixed to a tip of the pen shaft in an integrated manner and is connected to an ink reservoir inside the pen shaft. The thus-structured nib can be used in writing in many directions on a paper sheet. The nib can be used in writing from any positions and from any angles, even if the penis rotated about the pen shaft. In addition to that, characters of various features, such as characters of thick lines and thin lines, can be written by varying width of lines in accordance with writing pressure. Recently, the combtooth-shaped pieces have been made of an injection-molded plastic material in many cases in order to satisfy the demand for the improvement in machinability and in mass production.

However, writing instruments with such plastic conical nibs have a problem that wear resistance at the nibs is low and the nibs wear easily as compared with metal or ceramic ones.

The present invention is made to solve these related art problems and an object thereof is to provide a wear-resistant conical nib even if the conical nib is made of a plastic material, and to provide a writing instrument using the conical nib.

SUMMARY OF THE INVENTION

According to one aspect of the invention, there is provided a conical nib which is fixed to a tip of a pen shaft including an ink reservoir and is connected to the ink reservoir via an ink supply wick having a capillary action, the nib including: a holder member formed in a tubular shape; and a plurality of combtooth-shaped pieces provided at one end side of the holder member, the plurality of combtooth-shaped pieces being shaped to form a substantially hemispherical tip and being converged, on the whole, gradually toward the tip in a substantially conical shape, the nib being formed in a conical shape including a writing tip at a tip thereof and ink feed paths formed between adjacent combtooth-shaped pieces, wherein the nib is made of a synthetic resin material in which engineering plastic, among other plastic, is used.

The nib may be made of engineering plastic, such as polyoxymethylene (POM), polyphenylene ether (PPE), polycarbonate (PC), polybutadiene terephthalate (PBT), polyamide (PA), or at least one of plastic materials similar to those listed above.

Further, the nib may be made of super engineering plastic, such as polyphenylenesulfide (PPS), polyethersulfone (PES), polyetheretherketone (PEEK), polyarylate (PAR), polysulfone (PSF), polyetherimide (PEI), or at least one of plastic materials similar to those listed above.

With the structure described above, since the nib is made of the synthetic resin material in which engineering plastic, among other plastic, is used, the writing instrument of the present invention is wear resistant and, therefore, duration of the nib or the writing instrument can be extended. Further, since the nib is highly elastic while it is made of a hard material, significant effects can be produced in that, for example, variation in writing pressure at, such as stop, hook and fade in writing characters, can express variation in the width of the written lines.

DESCRIPTION OF THE PREFERRED EMBODIMENTS

First Embodiment

Figure 1:
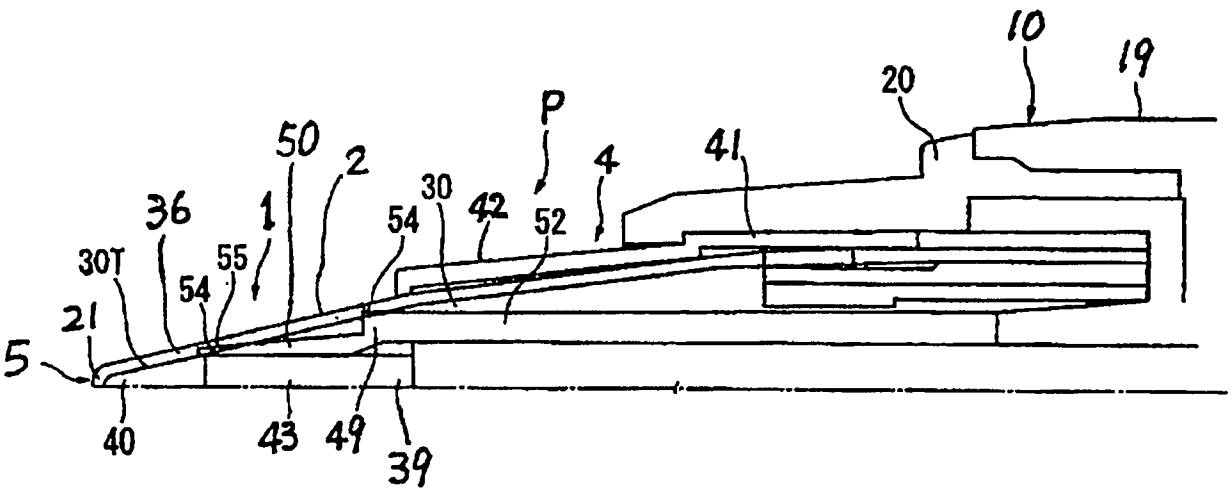
FIG. 1 is a partially cut-away enlarged sectional view illustrating a main part of a writing instrument according to a first embodiment of the present invention.

Hereinafter, a first embodiment of the invention will be described with reference to FIG. 1, and FIGS. 2 to 4 as needed. FIG. 1 illustrates a main part of a writing instrument. As illustrated in FIG. 1, a writing instrument P includes a pen shaft 10 and a conical nib 1. The nib 1 is connected to ink contained in the pen shaft 10 via an ink supply wick 39 which has a capillary action. The pen shaft 10 is made of, for example, a plastic material into a tubular shape, such as a cylindrical shape. The pen shaft 10 includes a shaft cylinder 19 of which a mouth piece (which is a tubular piece for fixing the nib 1) 20 is attached at a tip and a rear end is closed and an ink reservoir (not illustrated throughout the drawings) which is formed in an integrated manner inside the shaft cylinder 19. The nib 1 is inserted in the mouth piece 20 at the tip of the shaft cylinder 19 and the ink supply wick 39 is inserted in and disposed inside the shaft cylinder 19 on the tip side thereof. With this configuration, the ink reservoir is situated in a predetermined range on a rear side of the pen shaft 10. The ink reservoir stores ink. The ink reservoir is directly refilled with ink. Alternatively, the ink is held by an ink holding member, such as a synthetic fiber converging body and is stored in the ink reservoir. A cap (not illustrated) is attached to the tip of the shaft cylinder 19 over the nib 1. In this case, the cap is made of a plastic material formed in a tubular, e.g., cylindrical, shape, which opens at a rear end thereof and is closed at a front end thereof. The cap has a dual tubular structure in which a tubular-shaped sealing member which airtightly surrounds the nib is disposed in an integrated manner inside the tubular-shaped member.

Figure 2:
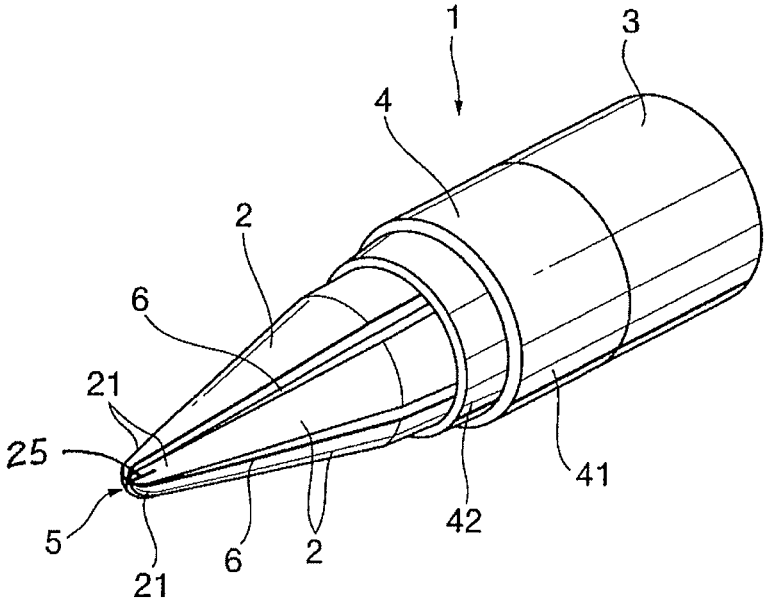
FIG. 2 is an enlarged perspective view illustrating a nib applied to the writing instrument.

As illustrated in FIG. 2, the nib 1 includes a plurality of combtooth-shaped pieces 2, a holder member 3 and a converging member 4. The combtooth-shaped pieces 2 are assembled together using the holder member 3 and the converging member 4. In this embodiment, each of the combtooth-shaped pieces 2 of the nib 1 is made of a synthetic resin material in which engineering plastic, among other plastic, is used. Each of the combtooth-shaped pieces 2 is manufactured independently and thus has an independent structure. The holder member 3 is manufactured independently from the combtooth-shaped pieces 2 and is made of a plastic material, a metallic material or a combination thereof. The entire holder member 3 is formed in a cylindrical shape. The converging member 4 is made of a metallic material, a resin material or a combination thereof. Note that the holder member 3 and the converging member 4 may also be made of a synthetic resin material in which engineering plastic, among other plastic, is used. This means that, in the present embodiment, the combtooth-shaped pieces 2 are made of engineering plastic while the materials of the holder member 3 and the converging member 4 are less strictly limited than those of the combtooth-shaped pieces 2.

If each part of the nib 1 is made of engineering plastic, the part is mainly manufactured by injection molding. Compounds or colored compounds of engineering plastic are used for polymeric material for molding. The compound is a mixture with, for example, an additive for adding performance and functions to the engineering plastic and a compatibilizer for enhancing the effects. The additive may add various performance and functions to pen products. For example, the additive may provide and control, as mechanical property, static property including strength, hardness, wear resistance, shock resistance and weather resistance, and dynamic property including lubricity, slippability, frictional performance and resistance. The compatibilizer may provide an auxiliary effect to easily promote mixture and dispersion (i.e., blending or alloying) of plastic and additives. A plasticizer and an unguent may be applied to increase efficiency in a molding process. The additive may be a natural product or a synthetic compound: Desirably, the additive may be a material, such as metal, glass, an inorganic compound and mineral, which may be widely added to plastic products, typical examples of the additive include metal powder, glass powder, carbon products, calcium carbonate, magnesium carbonate, silica, alumina, titania, calcium silicate, silicon carbide, diatomite, talc, clay, lubricant and a compatibilizer. As the particle diameter is smaller, the effect of the additive is enhanced. Thus, particulate powder is desirable. Regarding the particle shape, the fiber shape is desirable for its effect to dynamic elasticity (i.e., bending). A colorant may be added to change color rendering property of the nib in order to enhance design property of the pen product. Addition of the colorant may be carried out in a process of the colored compound. The additive, compatibilizer and colorant of the present invention may be used in combination of at least one kind (i.e., plural kinds) in accordance with required performance of the product. At least two or more kinds of engineering plastic, which is listed above, and general-purpose plastic may be selected and blended or mixed by polymer alloying. Alternatively, the combtooth-shaped pieces 2 or other parts may be made only of engineering plastic. Wear resistance of the combtooth-shaped pieces 2 made of engineering plastic during writing on a paper sheet has been significantly improved than that of related art combtooth-shaped pieces made only of general-purpose plastic. In some cases, wear resistance of the combtooth-shaped pieces 2 made of engineering plastic is equivalent to or greater than that of nibs of writing instruments of ordinary products in which a metal nib is processed with iridium or that of ceramic nibs. The term "general-purpose plastic" herein includes plastic materials other than (i.e., except for) engineering plastic. That is, general-purpose plastic has injection molding temperature of 100 to 150 degrees C. and is used for producing ordinary resin mold products. Typical examples of general-purpose plastic include vinyl chloride, polyethylene, polypropylene, polystyrene, ABS and polyethylene terephthalate (PET). ABS is a copolymer of acrylonitrile, butadiene and styrene. Examples of polymer alloy include PC/ABS and PPE/PS. PC is polycarbonate, PPE is polyphenylene ether and PS is polystyrene. Since engineering plastic used in the present invention has characteristics of plastic itself, the combtooth-shaped pieces 2 made of engineering plastic may be manufactured with high machinability and, therefore, is easily machined in molding, such as injection molding or cutting. In this regard, the present invention differs significantly from the related art metallic or ceramic nibs which have difficulty in machinability during manufacture and difficulty in increase in precision and yield.

In the present invention, engineering plastic includes so-called general-purpose engineering plastic with greater functions than those of general-purpose plastic, and super engineering plastic with even greater functions than those of the general-purpose engineering plastic. The general-purpose engineering plastic is advantageous in machinability and economical efficiency and super engineering plastic is advantageous in functions. The plastic included in the engineering plastic is heat resistant and such plastic may be melted and molded under high temperature of 200 to 350 degrees C. Examples of the general-purpose engineering plastic suitable as a material of the nib include polyoxymethylene (POM), polyphenylene ether (PPE), polycarbonate (PC), polybutadiene terephthalate (PBT), polyamide (PA) or plastic materials similar to those listed above. When high performance is important, polyphenylenesulfide (PPS), polyethersulfone (PES), polyetheretherketone (PEEK), polyarylate (PAR), polysulfone (PSF) and polyetherimide (PEI) are used as super engineering plastic. These plastic materials are thermoplastic high heat resistance polymer resin materials suitable for manufacturing the nib of the present invention. The present inventors made experiments regarding, for example, durability, operativity and cost, for various nibs 1 manufactured using above-described various kinds of engineering plastic and found that the nib made of POM among general-purpose engineering plastic is significantly suitable. Note that there is no problem in using the above-described engineering plastic in the parts other than the nib 1, such as the pen shaft 10 described above.

The combtooth-shaped pieces 2 made of engineering plastic is surface-treated or processed to roughen the surface thereof (i.e., roughened) in order to increase holdability of the ink to be fed to the paper sheet. The surface is roughened by a surface treatment process including, for example, sandblasting after the combtooth-shaped pieces 2 are injection-molded. Alternatively, an inner surface of a mold which is used for injection molding of the combtooth-shaped pieces 2 may be roughened in advance and then injection-molding is performed using the mold. Alternatively, the surfaces of the combtooth-shaped pieces 2 may be roughened by chemical reaction using chemical substances, such as medicines. Exemplary chemical roughing processes include blasting fluorine gas or chlorine gas onto the surfaces of the injection-molded combtooth-shaped pieces 2. The surfaces of the combtooth-shaped pieces 2 to be roughened are especially back surfaces, i.e., inner surfaces, of the combtooth-shaped pieces 2 when assembled to form a writing instrument. Other surfaces of the combtooth-shaped pieces 2 may also be roughened. A degree of roughening of the surfaces of the combtooth-shaped pieces 2 is determined such that, when the writing instrument is used for writing, the ink reached at the tip of the nib 1 from the ink reservoir is kept at the surfaces of the combtooth-shaped pieces 2 and is not allowed to drop on the paper sheet.

The plurality of combtooth-shaped pieces 2 are shaped to form a substantially hemispherical tip and capable of being converged, on the whole, gradually toward the tip in a substantially conical shape. Each of the combtooth-shaped pieces 2 is formed in a substantially sword-like shape having an arc-shaped cross-section along the widthwise direction. A hemispherical split portion 21 of predetermined dimension is formed at the tip of each combtooth-shaped piece 2. Desirably, a single or two or more slits 25 extending from the tip toward a base end (along an axial direction of the nib 1) may be formed at the tip of each combtooth-shaped piece 2. The slit(s) 25 extends a predetermined length linearly from the tip of the combtooth-shaped piece 2 within (or out of) a range of the writing tip 5. The base end of each combtooth-shaped piece 2 is formed as a to-be-fixed portion which is capable of being fixed to the holder member 3. The base end includes a flange portion and an increased diameter portion of which diameter is greater than that of the tip. A front side of the flange portion is used as the point of effort when the combtooth-shaped piece 2 is inserted in the holder member 3 using a pressure jig. The flange portion receives the force applied by the jig which is made to abut against the flange portion and press the same. A rear side of the flange portion is made to abut against a front end of a fixing portion of the holder member 3 to fix the combtooth-shaped piece 2 at that position. By precisely keeping the length from the rear side of the flange portion to the tip of each of the combtooth-shaped piece 2 to be constant, the tips of the combtooth-shaped pieces 2 may form the conical nib shape when a necessary number of combtooth-shaped pieces 2 are inserted around the circumference of the holder member 3. With this configuration, the writing tip 5 is shaped to be hemispherical as much as possible even if independent combtooth-shaped pieces 2 are assembled together and the entire nib may be gradually converged to be conical shape as much as possible. The number of the combtooth-shaped pieces 2 is preferably three to eight.

As described above, the holder member 3 is provided independently from the combtooth-shaped pieces 2 and is made of a plastic material, a metallic material or a combination thereof. The entire holder member 3 is formed in a cylindrical shape. Groove-shaped fixing portions are formed on an end face of the holder member 3. The to-be-fixed portions of the base ends of the combtooth-shaped pieces 2 may be inserted in the fixing portions along an axial direction (of the holder member 3). The base ends of the combtooth-shaped pieces 2 are inserted in the fixing portions of the holder member 3 so that the combtooth-shaped pieces 2 may be arranged around the circumference (of the end face of the holder member 3).

As described above, the converging member 4 also is made of a metallic material, a resin material or a combination thereof. The converging member 4 includes a substantially cylindrical column-shaped converging portion 41 and a conical trapezoidal narrowed portion 42. The converging portion 41 is formed in a cylindrical shape capable of fitting onto outer peripheries of the combtooth-shaped pieces 2 which are arranged around the circumference by the holder member 3. An outer diameter of the converging portion 41 is substantially equivalent to that of the holder member 3. An inner diameter of the converging portion 41 is determined such that the combtooth-shaped pieces 2 are pressed, at their intermediate portions on the side of the base ends, from outside toward inside to be converged to form a substantially cylindrical column shape. The narrowed portion 42 has an outer diameter and an inner diameter which are gradually reduced from those of the converging portion 41. The inner diameter of the narrowed portion 42 is determined such that the combtooth-shaped pieces 2 are pressed, at their intermediate portions on the side of the tip, from outside toward inside to be converged to form a substantially conical shape, and such that each of the hemispherical split portions 21 is converged to form a substantially hemispherical shape. Note that the converging member 4 may also be formed integrally with the mouth piece for attaching the nib 1 to the shaft cylinder 19 of the pen shaft 10.

In this manner, the base ends of the combtooth-shaped pieces 2 are inserted in the fixing portions of the holder member 3 and are arranged around the circumference (of the end face of the holder member 3), the combtooth-shaped pieces 2 are converged by the converging member 4 into the conical shape and the conical nib including the writing tip 5 at the tip thereof and ink feed paths 36 formed between adjacent combtooth-shaped pieces 2 is provided. A single or two or more slits 25 are formed at the tip of each combtooth-shaped piece 2 extending from the tip toward the base end. The tip of each combtooth-shaped piece 2 is further divided to form a hemispherical tip and the entire combtooth-shaped pieces gradually form a conical shape. With this configuration, even if the number of the combtooth-shaped pieces 2 is small, the tip formed by the combtooth-shaped pieces 2 is hemispherical as much as possible and the entire nib may be gradually converged to be conical as much as possible.

Figure 3:
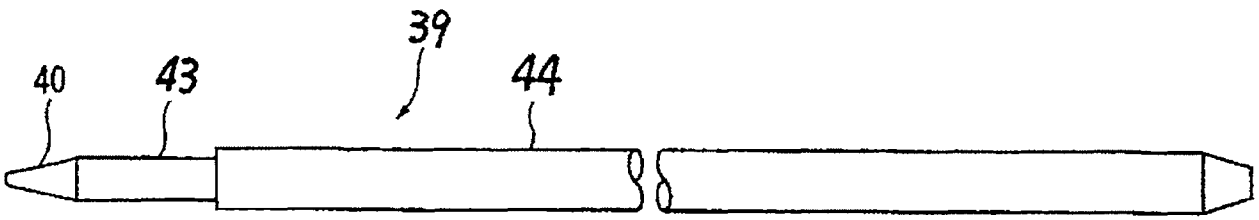
FIG. 3 is a partially cut-away enlarged plan view illustrating an ink supply wick applied to the writing instrument.
Figure 4:
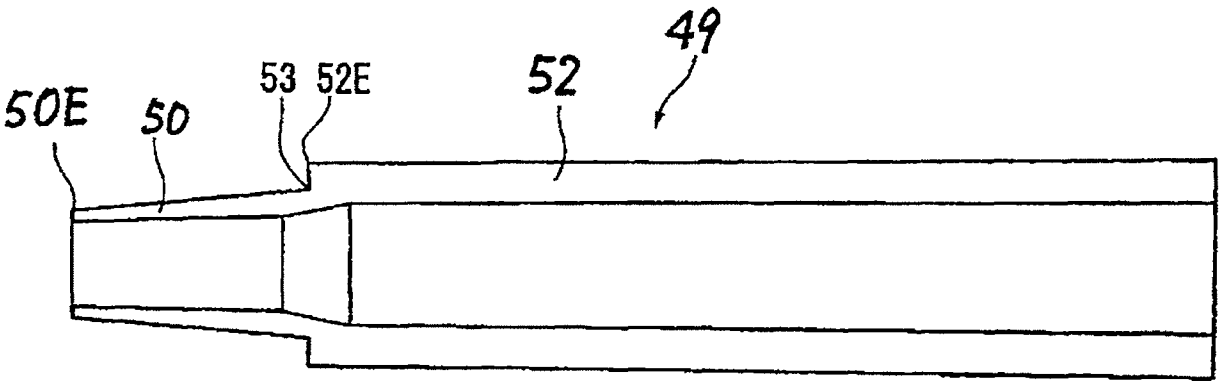
FIG. 4 is an enlarged plan view illustrating a wick cover applied to the writing instrument.

The ink supply wick 39 is inserted in a hollow space 30 in the nib 1. The nib 1 is attached to the tip of the pen shaft 10. A wick cover 49 is attached to an outer periphery of the ink supply wick 39. The ink supply wick 39 herein is a fiber wick (i.e., a fiber aggregate) made of, for example, polyester. The ink supply wick 39 has a length to be properly disposed inside the nib 1 and the pen shaft 10. As illustrated in FIG. 3, a tip of the ink supply wick 39 is formed in a substantially conical shape to be fit in the writing tip 5 of the nib 1 and a neighboring hollow tip 30T of the writing tip 5. A rear portion of the ink supply wick 39 is formed as a round rod. The rear portion of the ink supply wick 39 is formed as a stepped round rod which includes a front side round rod portion 43 and a rear side round rod portion 44. The front side round rod portion 43 is continued from a substantially conical shaped portion 40 at a tip. The rear side round rod portion 44 is continued from the front side round rod portion 43 with an increased outer diameter. A rear end of the rear portion is tapered toward a rear end face. An outer shape of the wick cover 49 is determined such that it is attached to the outer periphery of the ink supply wick 39 between the nib 1 and the ink supply wick 39 and is made to closely adhere to an inner periphery of the nib 1 at least at the tip of the nib 1. In this case, the wick cover 49 is made of a resin material having elasticity as illustrated in FIG. 4. The wick cover 49 includes a small-diameter conical trapezoidal portion (or a cylindrical portion) 50 and a large-diameter cylindrical portion 52. The small-diameter conical trapezoidal portion 50 may hold the tip side of the ink supply wick 39 (especially the front round rod portion 43). The large-diameter cylindrical portion 52 may hold an intermediate portion of the ink supply wick 39 (especially a front side of the rear round rod portion 44). A stepped portion 53 is formed between the small-diameter cylindrical portion 50 and the large-diameter cylindrical portion 52 and a tip outer peripheral edge 50E of the small-diameter conical trapezoidal portion 50 and a front outer peripheral edge 52E of the large-diameter cylindrical portion 52 become a close contact portion 54 which is compressed in an inner periphery of the nib and is pressed against inner surface of each combtooth-shaped piece 2 and an expanding portion 55 which is pressed out into grooves (i.e., the ink feed paths 36) between adjacent each combtooth-shaped piece 2. In this manner, the ink supply wick 39 is inserted along in the shaft center of the wick cover 49 and a conical tip of the ink supply wick 39 is made to protrude through the wick cover 49. The wick cover 49 is attached to an outer peripheral surface on a tip side of the ink supply wick 39. The ink supply wick 39 is inserted in the hollow space 30 from a base end side of the nib 1 to the tip and disposed therein. The tip of the ink supply wick 39 is fit in an end of the hollow space 30, i.e., the writing tip 5 and the neighboring hollow tip 30T of the hollow space 30. A conical trapezoidal tip edge portion and a cylindrical column-shaped front end edge portion of the wick cover 49 are made to closely adhere to the inner circumference of the nib 1. A space between the nib 1 and the ink supply wick 39 is filled with the wick cover 49 at the tip side of the nib 1. An outer periphery of ink supply wick 39 is surrounded by the wick cover 49 between the nib 1 and the ink supply wick 39. In this manner, the base end side of the nib 1 is fixed to the tip of the pen shaft 10 via the mouth piece 20 and the ink supply wick 39 is connected to the ink reservoir within the pen shaft 10 (i.e., the shaft cylinder 19).

With this configuration, the tip of the combtooth-shaped pieces 2 is formed to be hemispherical as much as possible and the entire nib is converged to be conical as much as possible. Thus, a hemispherical writing tip 5 which is not displaced at the tip thereof is formed and the certain ink feed paths 36 are formed between adjacent combtooth-shaped pieces 2. With this configuration of the nib 1, when the hemispherical writing tip 5 is pressed against a paper sheet at a certain angle with respect to the shaft center of the pen shaft 10 thereof, the hemispherical split portions 21 of the combtooth-shaped pieces 2 are displaced from one another to cause elastic deformation and an outer diameter of the hemispherical tip is increased. When the pressing operation against the paper sheet is released, the tip elastically restores its original hemispherical shape. The thus-configured nib 1 may be used in writing in many directions on a paper sheet. The nib 1 can be used in writing from any positions and from any angles, even if the nib is rotated about the shaft center of the pen shaft 10. In addition to that, the width of lines can be changed by varying intensity of writing pressure: therefore, characters of various features, e.g., brush-characters, such as characters of thick lines and thin lines, can be written. In accordance with the writing pressure, the combtooth-shaped pieces 2 deform and absorb the writing pressure. This cushioning effect provides a soft pen touch to fingers of the writer so that the writer will not easily get tired after long hours of writing. The cushioning effect reduces deformation or wear of the nib if the writing pressure is large and thus improves durability of the writing portion. Even if the pen is left unused for a long time or the moisture on a surface of the nib evaporates and the narrow gaps at the tip of the nib is clogged with dried ink, restarting of a writing action causes the writing tip 5 to move and the hemispherical portions are deformed. The narrow gaps are then deformed to break a dried ink film or block and then the ink can be easily taken out again. The slits 25 provided at the tips of the combtooth-shaped pieces 2 cause elastic deformation of the writing tip 5. The slits 25 have the same ink feeding effect as that of the ink feed paths 36. With this configuration, the above-described writing performance can be improved as much as possible.

In this writing instrument P, the wick cover 49 is attached to the outer periphery of the ink supply wick 39 between the nib 1 and the ink supply wick 39. The wick cover 49 is made to closely adhere to the inner periphery of the nib 1 at least at the tip side of the nib 1 and a space between the nib 1 and the ink supply wick 39 is filled with the wick cover 49. With this configuration, even if the pen is kept with the nib 1 facing downward, it is possible to prevent the ink from accumulating in the space between the nib 1 and the ink supply wick 39, thereby reliably preventing dropping of ink. Since an outer periphery of the ink supply wick 39 is surrounded by the wick cover 49 between the nib 1 and the ink supply wick 39, although the nib 1 has a large exposed portion, drying up of the nib 1 (i.e., the ink supply wick 39) when the cap is not attached can be prevented reliably.

In this embodiment, the nib 1 is configured in the following manner: each of the combtooth-shaped pieces 2 made of engineering plastic and the holder member 3 which has wider choice of materials are manufactured separately, each of the combtooth-shaped pieces 2 is assembled to the holder member 3, and then the converging member 4 converges the combtooth-shaped pieces 2 into a conical shape. In the manufacture of the nib 1 in which the combtooth-shaped pieces and the base portion are provided separately, it is desirable that the holder member 3 is manufactured by molding any plastic material other than engineering plastic while the combtooth-shaped pieces 2 are made of engineering plastic. With such a configuration, even if the combtooth-shaped pieces 2 made of engineering plastic are very hard and lack flexibility during writing, since the holder member 3 which is a base portion of the combtooth-shaped pieces 2 is made of the plastic material of which hardness is lower than that of engineering plastic, the combtooth-shaped pieces 2 are supported by the holder member 3 which is highly elastic. Therefore, a higher degree of elasticity is provided to the combtooth-shaped pieces 2.

As Modification of the present embodiment, each of the combtooth-shaped pieces may be formed integrally with the base portion. Alternatively, the combtooth-shaped pieces may be machined into a (conically) converged state and the converging member may be omitted. In this case, an integral structure of the combtooth-shaped pieces and the base portion is made of engineering plastic. In such a nib structure, in a form in which an ink supply wick is inserted and disposed in the hollow space of the nib, a similar operation effect can be obtained by attaching a wick cover to an ink supply wick.

Second Embodiment

Next, a second embodiment of the present invention will be described with reference to the attached drawings. In this second embodiment, the structure of the nib in which the combtooth-shaped pieces and the base portion are provided separately in the above-described first embodiment will be described in more detail.

Figure 5:
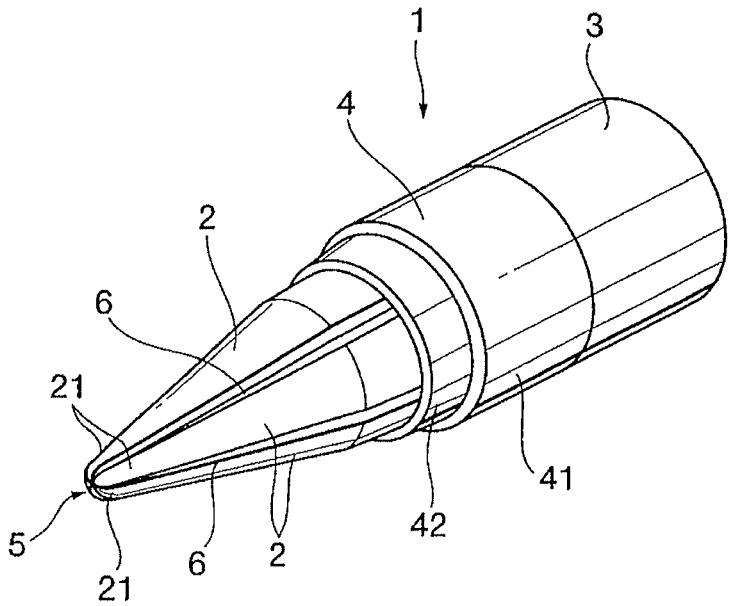
FIG. 5 is a perspective view of a conical nib according to a second embodiment of the present invention.

FIG. 5 is a perspective view of a conical nib according to the second embodiment of the present invention. In FIG. 5, 1 denotes a conical nib (hereafter, referred to as "nib") which includes a plurality of combtooth-shaped pieces 2, a holder member 3 and a converging member 4. The plurality of combtooth-shaped pieces 2 are assembled to form a conical nib shape by the holder member 3 and the converging member 4. A writing tip 5 is formed at a tip and ink feed paths 6 are formed between adjacent combtooth-shaped pieces 2. The combtooth-shaped pieces 2 in this embodiment are, like those of the first embodiment, made of engineering plastic. The holder member 3 and other parts may be made of a metallic material, a resin material, a combination thereof, or engineering plastic listed above. The materials of the combtooth-shaped pieces 2, and the methods for molding and roughening the combtooth-shaped pieces 2 are the same as those of the first embodiment.

Figure 6A:
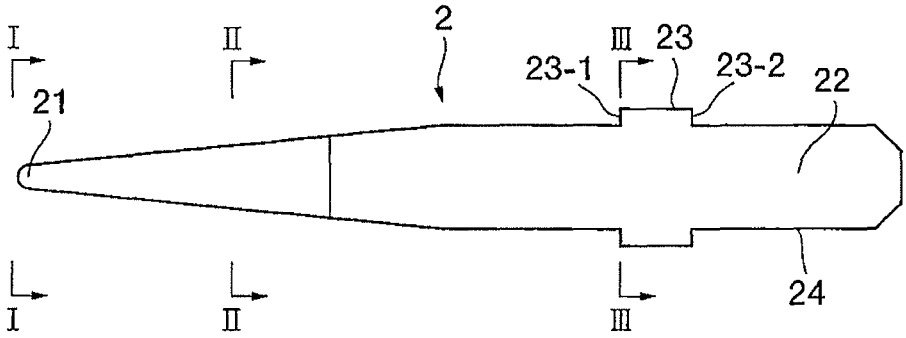
FIG. 6A is a plan view illustrating each combtooth-shaped piece of the nib.
Figure 6B:
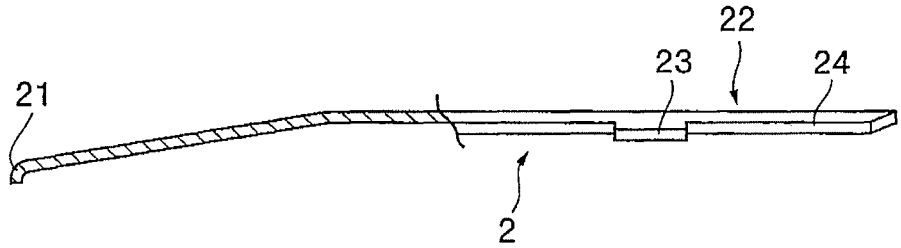
FIG. 6B is a partially sectioned side view illustrating each combtooth-shaped piece of the nib.
Figures 6C, 6D, 6E:
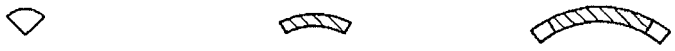
FIG. 6C is a cross-sectional view (along line I-I of FIG. 6A) illustrating each combtooth-shaped piece of the nib.
FIG. 6D is a cross-sectional view (along line II-II of FIG. 6A) illustrating each combtooth-shaped piece of the nib.
FIG. 6E is a cross-sectional view (along line of FIG. 6A) illustrating each combtooth-shaped piece of the nib.
Figure 7:
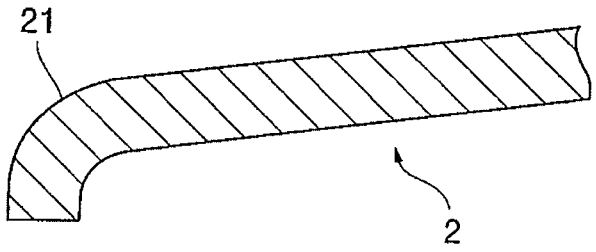
FIG. 7 is a partially cut-away enlarged lateral cross-sectional view illustrating a main part of each combtooth-shaped piece of the nib.
Figure 10:
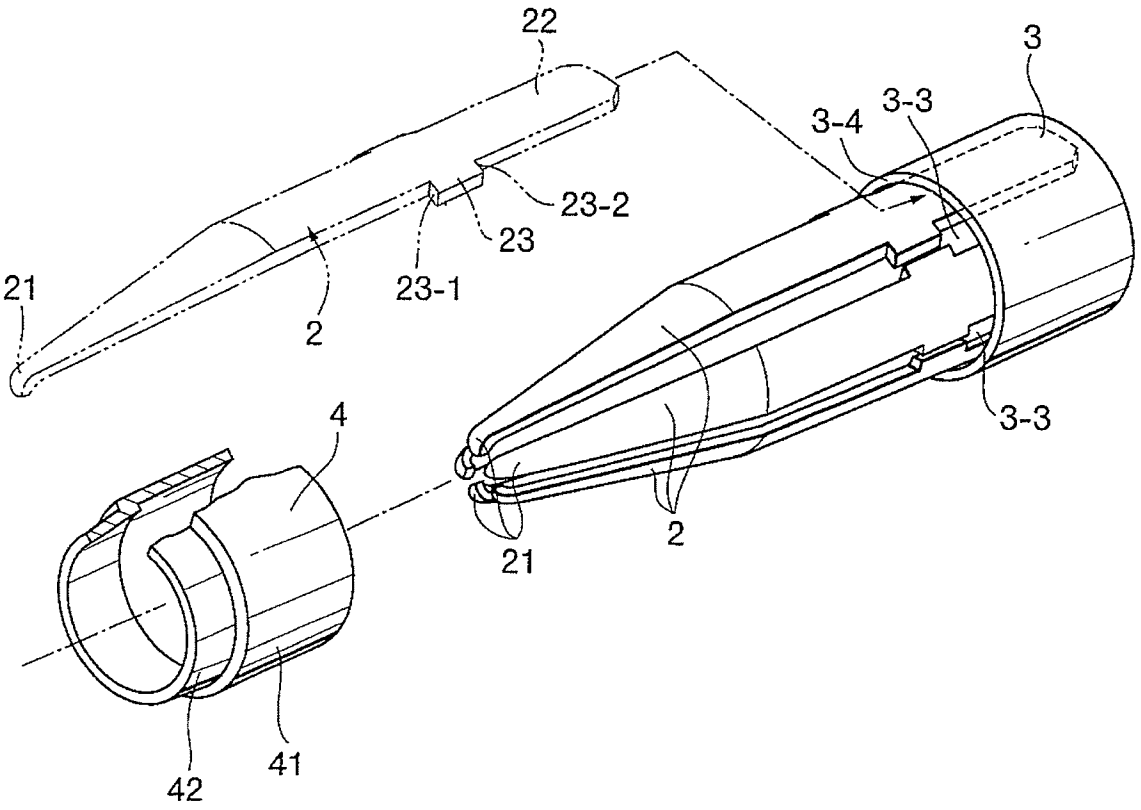
FIG. 10 is a perspective view illustrating a state in which a plurality of combtooth-shaped pieces of the nib have been fixed to the holder member and before a converging member is attached.

The plurality of combtooth-shaped pieces 2 are shaped to form a substantially hemispherical tip and capable of being converged gradually toward the tip in a substantially conical shape. Each of the entire combtooth-shaped pieces 2 is formed in a substantially sword-like shape as illustrated in FIG. 6A having an arc-shaped cross-section along the widthwise direction as illustrated in FIGS. 6B to 6E. As illustrated in FIG. 7, a hemispherical split portion 21 of predetermined dimension is formed at the tip of each combtooth-shaped piece 2. As illustrated in FIG. 6A, a base end 22 of each combtooth-shaped piece 2 is formed as a to-be-fixed portion which is capable of being fixed to the holder member 3. The base end 22 includes a flange portion 23 and an increased diameter portion 24 of which diameter is greater than that of the tip. A front side 23-1 of the flange portion 23 is used as the point of effort when the combtooth-shaped piece 2 is inserted in the holder member 3 using a pressure jig. The flange portion 23 receives the force applied by the jig which is made to abut against the flange portion 23 and press the same. A rear side 23-2 of the flange portion 23 is made to abut against a front end of a fixing portion of the holder member 3 to fix the combtooth-shaped piece 2 at that position. By precisely keeping the length from the rear side 23-2 of the flange portion 23 to the tip of each of the combtooth-shaped piece 2 to be constant, the tips of the combtooth-shaped pieces 2 may form the conical nib shape when a necessary number of combtooth-shaped pieces 2 are inserted around the circumference of the holder member 3 as illustrated in FIG. 10. With this configuration, the writing tip 5 is aligned accurately even if independent combtooth-shaped pieces 2 are assembled together. The number of the combtooth-shaped pieces 2 is preferably five to eight.

Figure 8:
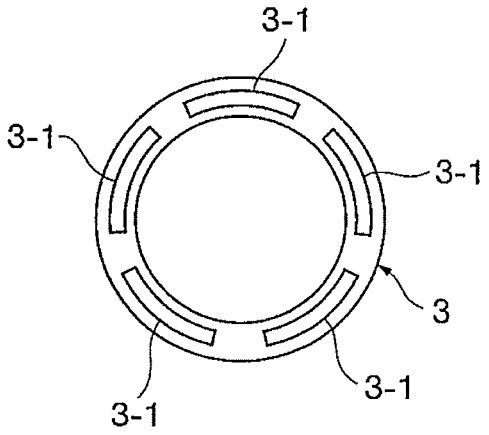
FIG. 8 is an end view illustrating a holder member of the nib.

As illustrated in FIG. 8, the entire holder member 3 is formed in a cylindrical. Groove-shaped fixing portions 3-1 are formed on an end face of the holder member 3. The to-be-fixed portions 22 of the base ends of the combtooth-shaped pieces 2 may be inserted in the fixing portions 3-1 along an axial direction (of the holder member 3). The base ends 22 of the combtooth-shaped pieces 2 are inserted in the fixing portions 3-1 of the holder member 3 so that the combtooth-shaped pieces 2 may be arranged around the circumference (of the end face of the holder member 3). The holder member 3 is made of a metallic material, a resin material or a combination thereof.

Figure 9:
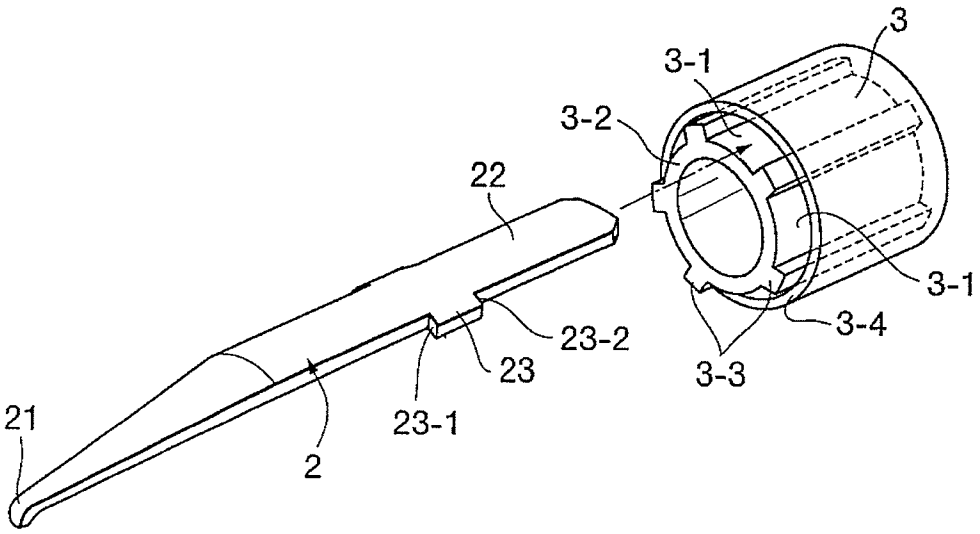
FIG. 9 is a perspective view illustrating a holder member according to another embodiment applied to the nib.

Modification of this holder member 3 is illustrated in FIG. 9. In this holder member 3, a member formed in the cylindrical shape is divided into two layers. An inner layer of the cylindrical body 3-2 is made of a resin material which is injection-molded using a mold. A plurality of projections 3-3 are formed on an outer periphery of this molded member at regular intervals to substantially the same height as that of the cylindrical body 3-2 which is the molded member. A metal pipe 3-4 which corresponds to an outer layer is press fit onto the outer diameter of the projections 3-3 to form a component of the holder member 3. Gaps formed between the pipe 3-4 and the projections 3-3 are formed as fixing portions 3-1 in which the base ends 22 of the combtooth-shaped pieces 2 are inserted and fixed. In this configuration, since the plurality of combtooth-shaped pieces 2 may be arranged around the circumference of the cylindrical body 3-2 and inside the outer layer pipe 3-4 cylindrically, and the outer layer pipe 3-4 may be made of metal, the base ends 22 of the combtooth-shaped pieces 2 are securely fixed to the fixing portions 3-1 of the gaps by being guided by the projections 3-3 so that no shaking occurs in the lateral direction. In this configuration, the thickness of the outer layer pipe 3-4 may be reduced sufficiently, the step between the arrangement circle of the combtooth-shaped pieces 2 and the outer layer pipe 3-4 is reduced to the minimum and, moreover, no deformation to the outside is caused. Therefore, the entire configuration becomes compact. This cylindrical body 3-2 may be formed by extrusion molding using a resin material with the projections 3-3 being attached or by extrusion molding using a metallic material, and may be manufactured with still higher productivity as parts cut to required length.

Figure 11:
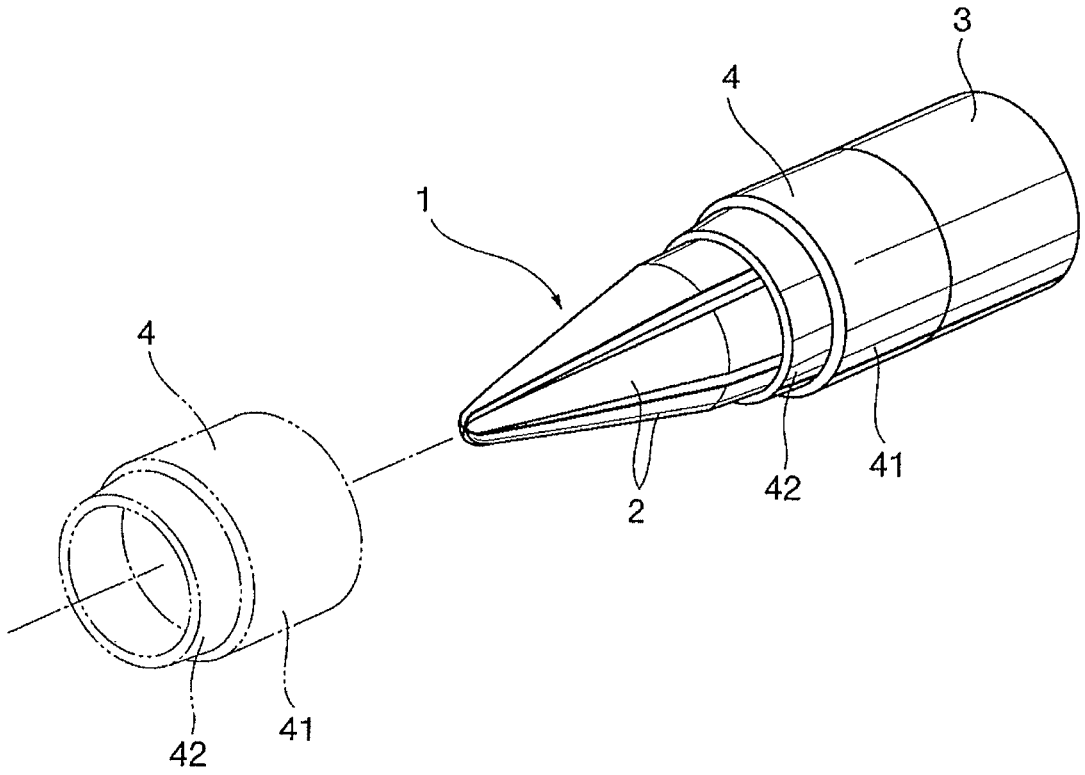
FIG. 11 is a perspective view illustrating a state in which a plurality of combtooth-shaped pieces of the nib have been fixed to the holder member and after the converging member is attached.

As illustrated in FIGS. 5, 10 and 11, the converging member 4 includes a substantially cylindrical column-shaped converging portion 41 and a conical trapezoidal narrowed portion 42. the converging portion 41 is formed in a cylindrical shape capable of fitting onto outer peripheries of the combtooth-shaped pieces 2 which are arranged around the circumference by the holder member 3. An outer diameter of the converging portion 41 is equivalent to that of the holder member 3. An inner diameter of the converging portion 41 is determined such that the combtooth-shaped pieces 2 are pressed, at their intermediate portions on the side of the base ends, from outside toward inside to be converged to form a substantially cylindrical column shape. The narrowed portion 42 has an outer diameter and an inner diameter which are gradually reduced from those of the converging portion 41. The inner diameter of the narrowed portion 42 is determined such that the combtooth-shaped pieces 2 are pressed, at their intermediate portions on the side of the tip, from outside toward inside to be converged to form a substantially conical shape, and such that each of the hemispherical split portions 21 is converged to form a substantially hemispherical shape. The converging member 4 is made of a metallic material, a resin material or a combination thereof. The converging member 4 may also be formed as a mouth piece with which the nib 1 is attached to the drum portion of the shaft cylinder of the pen shaft body.

A method of manufacturing the nib 1 will be described briefly here. The method of manufacturing the nib 1 includes a molding process, a fixing process and an assembling process. In the molding process, the component parts of nib 1, i.e., the plurality of combtooth-shaped pieces 2, the holder member 3 and the converging member 4 are molded. In the fixing process, the base ends 22 of the plurality of combtooth-shaped pieces 2 are inserted in the fixing portions 3-1 of the holder member 3 and are fixed around the circumference (see FIG. 10). In the assembling process, the converging member 4 is fit onto the outer peripheries of the plurality of combtooth-shaped pieces 2 so as to converge the combtooth-shaped pieces 2 (refer to FIG. 11). When the plurality of combtooth-shaped pieces 2 are inserted in the fixing portions 3-1 of the holder member 3, each combtooth-shaped piece 2 is pressed into each fixing portion 3-1 with a stage of a front side 23-1 of the flange portion 23 being pressed such that a stage of a rear side 23-2 of the flange portion 23 is made to abut against a holding portion (the projection 3-3 in the case of FIG. 9).

In the molding process, since the nib 1 is formed by three kinds of component parts and the shape of the combtooth-shaped piece 2, among these component parts, is simplified, the metal mold used for molding of these parts is simplified significantly. Especially, it is necessary that dimensional accuracy of required shape should be achieved regarding that, for example, the entire combtooth-shaped piece 2 is gradually tapered toward the tip thereof and in a direction to gradually approach the axial center, and each of the combtooth-shaped pieces 2 has a circular arc cross section and that the hemispherical split portion 21 at the tip is divided into ⅕, ⅙, ⅐ or ⅛ of the hemispherical tip depending on the number of the combtooth-shaped piece 2. However, since each combtooth-shaped piece 2 is manufactured separately and independently, check of dimensional accuracy is easy whereby product failure may be prevented. Each corner of an outer surface of the hemispherical split portion 21, i.e., a corner between an outer surface and a side surface of the hemispherical split portion 21 is ground by, for example, blasting, barrel finishing or buffing so as to round out (i.e., round) the corner of the hemispherical split portion 21 to prevent the corner from being caught when each hemispherical split portion 21 touches the paper sheet. In this case, since the plurality of combtooth-shaped pieces 2 are in separated from each other before being attached, the rounding operation described above is easy.

Figure 12:
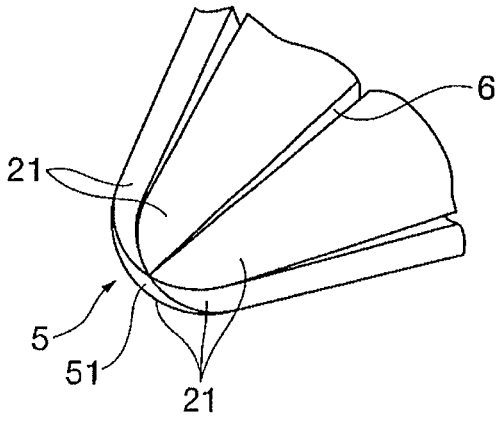
FIG. 12 is a perspective view of a writing tip of the nib.
Figure 13:
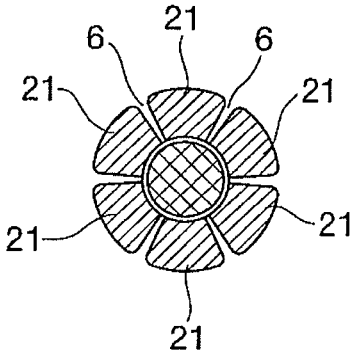
FIG. 13 is a cross-sectional view of the writing tip of the nib.

In the assembling process, since the shape of each part is simplified, each part can be assembled on an automatic feeder, such as a parts feeder. Especially, since the assembling process only includes a simple operation of fitting the plurality of combtooth-shaped pieces 2 in the fixing portions 31 of the holder member 3 and a simple operation of fitting the converging member 4 onto the outer peripheries of the plurality of combtooth-shaped pieces 2, automation of the assembly line is easy. In the operation of inserting five to eight combtooth-shaped pieces 2 in the fixing portions 31 of the holder member 3, these combtooth-shaped pieces 2 are arranged at equal intervals around the circumference of the shaft, and slit-shaped grooves are formed between the adjacent combtooth-shaped pieces 2. These combtooth-shaped pieces 2 are connected to one end face of the holder member 3. The half of the combtooth-shaped piece 2 on the base end side extends substantially linearly from the end face of the holder member 3. The half of the combtooth-shaped piece 2 on the tip side is inclined in the direction to gradually approach the shaft center toward the tip and is formed in a shape of a beak. Therefore, since each combtooth-shaped piece 2 is connected to the holder member 3 with its cross-sectional shape being divided into a conical shape and curved, each combtooth-shaped piece 2 has the same configuration as that of a triangular cantilever plate of which one end fixed to the fixing portion 31 of the holder member 3 being a fixed end, i.e., a cantilever beam of which one end is fixed. After these combtooth-shaped pieces 2 and the holder member 3 are assembled, an operation of fitting the converging member 4 onto the outer peripheries of these combtooth-shaped pieces 2 is performed. In this case, the converging member 4 is fit until a peripheral edge portion of the end face of the converging portion 41 is made to butt against a peripheral edge portion of the end face of the holder member 3. The five to eight combtooth-shaped pieces 2, on the base end side, are pressed from the outer circumferential direction toward the shaft center to be narrowed inwardly by the converging portion 41 of this converging member 4. The intermediate portions, on the base end side, of the combtooth-shaped pieces 2 are converged in the substantially cylindrical shape. The intermediate portions, on the tip side, of the combtooth-shaped pieces 2 are pressed from the outer circumferential direction toward the shaft center to be narrowed inwardly by the narrowed portion 42 of this converging member 4. These combtooth-shaped pieces 2 are converged from the intermediate portions toward the tip ends thereof into the conical shape, and the hemispherical split portion 21 at the tip of each combtooth-shaped piece 2 is converged in the hemispherical shape further. While averaged pressure of the converging member 4, the five to eight combtooth-shaped pieces 2 are converged into the cylindrical shape without distortion on the base end side thereof and are gradually tapered and converged into the conical shape without distortion on the tip side thereof. In addition to that, as illustrated in FIGS. 12 and 13, the hemispherical split portions 21 at the tip of the combtooth-shaped pieces 2 are converged by elastic contact of adjacent combtooth-shaped pieces 2 and a smooth hemispherical writing tip 5 having no projections and recesses is formed at that place. A top portion 51 of the writing tip 5 becomes a writing portion at which a plurality of tips of the combtooth-shaped pieces 2 are assembled into a circular shape having a flower petal-shaped cross section. An outer periphery of the top portion 51 is pressed against and is brought into contact with the paper sheet at the time of writing. The ink feed paths 6 which form capillary tube gaps are formed at joint portions of both sides of the combtooth-shaped pieces 2, i.e., between adjacent combtooth-shaped pieces 2.

Figure 14:
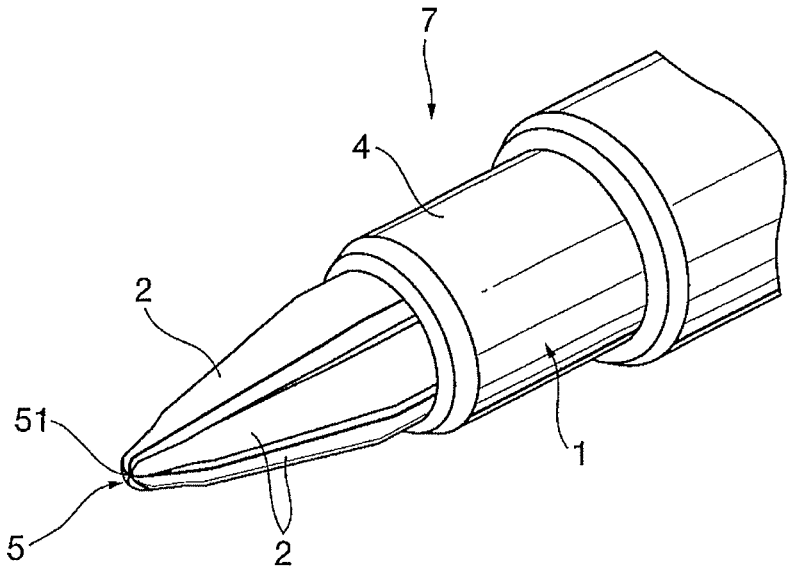
FIG. 14 is a partially cut-away perspective view of a writing instrument in which the nib is used.

Next, a writing operation with the writing instrument in which the nib 1 is used will be described with reference to FIGS. 14 to 19. A writing instrument 7 in which the nib 1 is used is illustrated in FIG. 14. In this writing instrument 7, each combtooth-shaped piece 2 of the nib 1 is a split piece which constitutes the conical shape and each combtooth-shaped piece 2 includes an independent tip. That is, the shape of the tip of each combtooth-shaped piece 2 is formed as one of a plurality of divided pieces of a hemisphere. The intermediate portion of each combtooth-shaped piece 2 which is connected to the cylindrical holder member 3 (see FIG. 5) is cylindrical in cross section, is divided, and is curved. Each combtooth-shaped piece 2 is fixed to the holder member 3. each combtooth-shaped piece 2 has the same configuration as that of a triangular cantilever plate of which one end fixed to the holder member 3 being a fixed end, i.e., a cantilever beam of which one end is fixed. Therefore, when writing with the writing instrument 7, if the force to press the tip of the combtooth-shaped piece 2 upward (i.e., bending force) is applied when the writing pressure is applied to the nib 1, the combtooth-shaped pieces 2 carry out bending deformation with a position at which the combtooth-shaped pieces 2 are fixed by the converging member 4 being the fulcrum and, if this force to press the tip upward is released, the combtooth-shaped pieces 2 restore to their original shapes.

Figure 15:
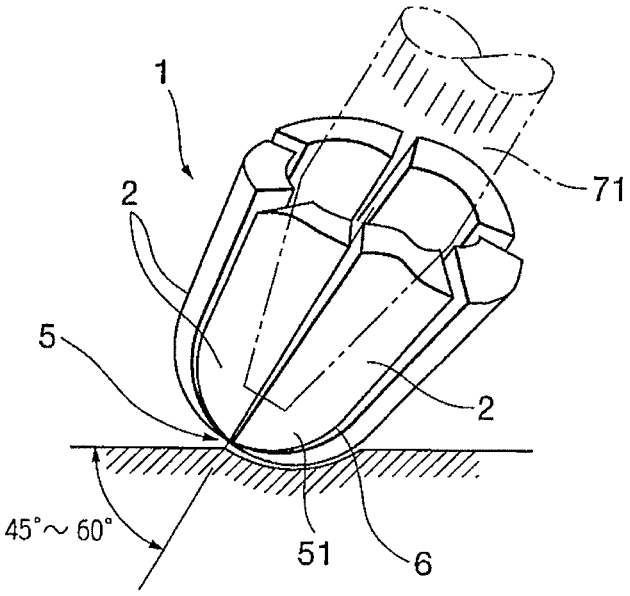
FIG. 15 is a fragmentary perspective view illustrating a state in which the writing tip of the nib is pressed against a paper sheet.

At the top portion 51 of the nib 1, such combtooth-shaped pieces 2 are collected in the conical shape and the tips of the combtooth-shaped pieces 2 are collected to form a hemispherical writing tip 5. The top portion 51 is illustrated in three dimensions, or in top view in FIG. 15, 16A or 18A. Here, FIG. 15 is a fragmentary perspective view illustrating a state in which the top portion 51 of the nib 1 of which conical portion is constituted by six combtooth-shaped pieces 2 is in contact with the paper sheet. The reference numeral 71 denotes an ink guide wick in FIG. 15. As illustrated in FIG. 15, when the nib 1 is pressed against a paper sheet at a practical angle of, usually, 45 to 60 degrees to perform writing with this writing instrument 7, the ink which has reached a joint gap of the top portion 51 of the nib 1 corresponding to a contact surface side with the paper sheet, i.e., the ink which has reached inside the tip end of the ink feed path 6, is sucked by capillarity produced on the contact surface between the paper sheet and the top portion 51 and the ink is transferred to the paper sheet and a line can be written. An elastic deformation effect (or an elastic deformation operation) of the hemispherical writing tip 5 due to writing pressure here is illustrated in FIGS. 16A to 19.

Figure 16:
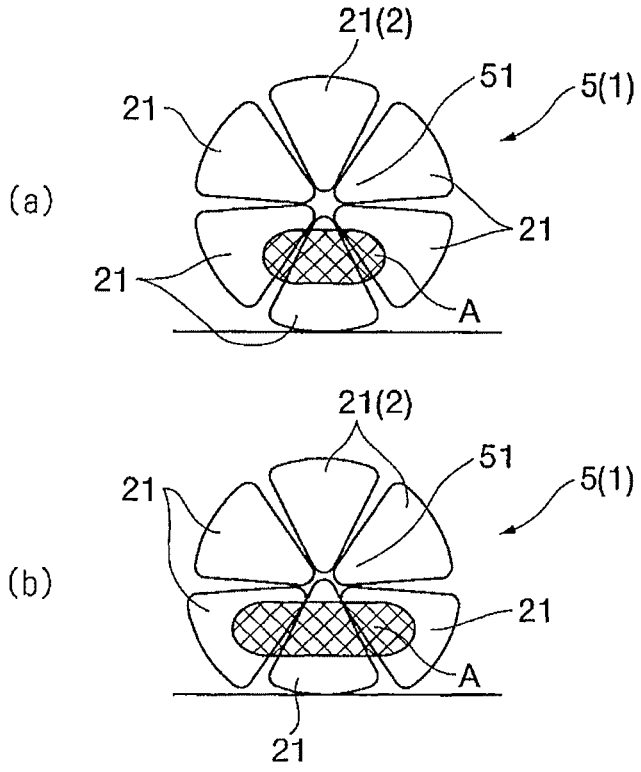
FIGS. 16A and 16B are end views illustrating an operation of the writing tip of the nib.
Figure 17:
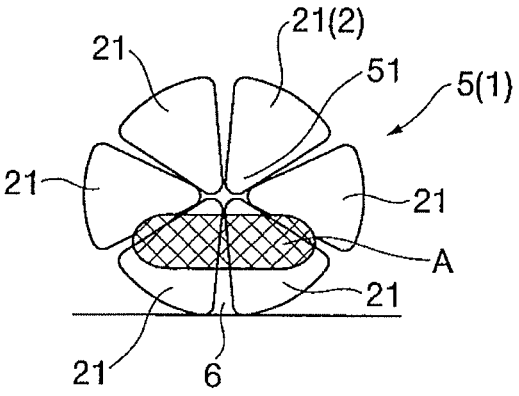
FIG. 17 is an end view illustrating an operation of the writing tip of the nib.
Figure 18:
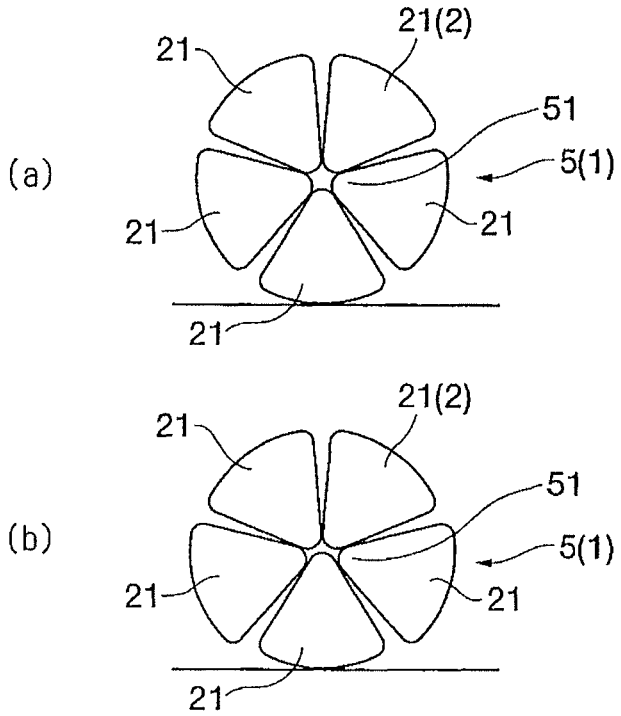
FIGS. 18A and 18B are end views illustrating an operation of the writing tip constituted by a different number of combtooth-shaped pieces of the nib.
Figure 19:
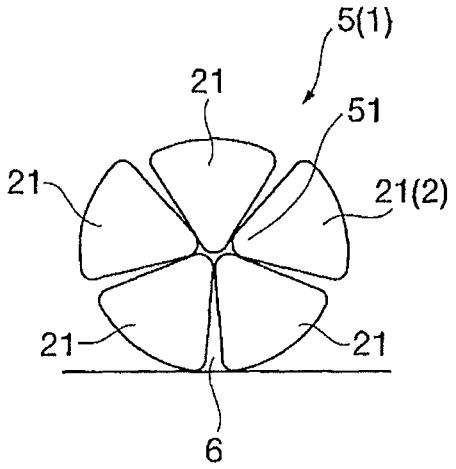
FIG. 19 is an end view illustrating an operation of the writing tip constituted by a different number of combtooth-shaped pieces of the nib.

FIGS. 16A, 16B and 17 are end views illustrating a change in the shape of the writing operation of writing tip 5 of the nib 1 constituted by six combtooth-shaped pieces 2 accompanying a writing operation. FIGS. 18A, 18B and 19 are end views illustrating a change in the shape of the writing operation of writing tip 5 of the nib 1 constituted by five combtooth-shaped pieces 2 accompanying a writing operation. FIG. 16A illustrates a state of the top portion 51 in which the top portion 51 has not touched the paper sheet yet or the top portion 51 has touched lightly but pressure is not applied under a condition in which the pen is directed to the paper sheet with one of the combtooth-shaped pieces 2 facing immediately below at the tip of the nib 1. In this case, since the bending force is not applied to any of the combtooth-shaped pieces 2, adjacent combtooth-shaped pieces 2 are in elastic contact. Next, when a writer applies the force to the nib 1 to write, for example, a character, the top portion 51 is bent as the tip of the combtooth-shaped piece 2 with a position at which the combtooth-shaped pieces 2 are fixed by the converging member 4 being the fulcrum and is moved upward with the writing pressure. However, since the material of the combtooth-shaped piece 2 has rigidity, resistance force is caused. Therefore, bending of the tip is as small as a predetermined movement, i.e., displacement, when the writer applies usual writing pressure. This displacement is, for example, 0.1 to 0.5 mm. As illustrated in FIG. 16B, if the hemispherical top portion 51 seen from the front, the tip of the combtooth-shaped piece 2 located at the lower position among the plurality of combtooth-shaped pieces 2 which constitute the top portion 51 is pressed upward and pushes the combtooth-shaped piece 2 located at the opposed position upward. At the same time, the combtooth-shaped pieces 2 located on both sides are pushed out to the left and right. In this manner, the hemispherical shape is deformed and the entire writing tip 5 is deformed.

Therefore, in general, the outer diameter of the hemispherical portion of the tip and the area in which the tip touches the paper sheet becomes large. The area A, illustrated by diagonal lines in FIG. 16B, in which nib touches the paper sheet is increased. The degree of increase becomes high as the pressure with which the nib 1 is pressed against the paper sheet, i.e., the writing pressure, is large. The thickness of a written line is dependent on the outer diameter of the top portion 51 which is expanded in accordance with the expansion of the hemispherical shape. If the writing pressure is large, the line width is great and, if the writing pressure is small, the line width is narrow. In accordance with the intensity of the writing pressure, the entire combtooth-shaped pieces 2 are bent and a cushioning effect to absorb the writing pressure by the entire combtooth-shaped pieces 2 if the writing pressure is large is produced.

Unlike the case illustrated in FIGS. 16A and 16B, FIG. 17 illustrates a deformed state of the top portion 51 when the pressure is applied to the top portion 51 of the nib 1 under a condition in which the pen is directed to the paper sheet with the ink feed path 6 which is a boundary of two combtooth-shaped pieces 2 at the tip of the nib 1 facing immediately below is illustrated. In this case, if the hemispherical writing tip 5 is seen from the front, the tips of the two combtooth-shaped pieces 2 located at the lower position of the pen among the plurality of combtooth-shaped pieces 2 which constitute the top portion 51 are pressed upward with the writing pressure and other combtooth-shaped pieces 2 are pushed out, whereby the hemispherical top portion 51 carries out elastic deformation. Other operations or behaviors are the same as those described with reference to FIGS. 16A and 16B. Even if the writing state is other than those illustrated in FIGS. 16A, 16B and 17, that is, wherever the pen is at the rotation angle position about the pen shaft, if the top portion 51 of the nib 1 touches the paper sheet at a certain angle, the writing tip 5 is expanded slightly by elastic deformation and performs the same operations or behaviors as those described above.

Also in the writing tip 5 illustrated in FIGS. 18A and 18B, the same deformation in the writing operation as that described with reference to FIGS. 16A and 16B occurs. That is, FIG. 18A illustrates a state of the top portion 51 in which the top portion 51 has not touched the paper sheet yet or the top portion 51 has touched lightly but pressure is not applied under a condition in which the pen is directed to the paper sheet with one of the combtooth-shaped pieces 2 facing immediately below at the tip of the nib 1. In this case, since the bending force is not applied to any of the combtooth-shaped pieces 2, adjacent combtooth-shaped pieces 2 are in elastic contact. Next, when the writer applies the force to the nib 1 to write, for example, a character, the top portion 51 is bent as the tip of the combtooth-shaped piece 2 which is fixed to the holding member 3 is moved upward with the writing pressure. In this case, with the normal writing pressure, the tip is deformed by, for example, 0.1 to 0.5 mm which is the same as the case described with reference to FIG. 16. In this case, if the hemispherical writing tip 5 is seen from the front, since the portion of the conical portion of the nib 1 is constituted by five combtooth-shaped pieces 2, the tip of the combtooth-shaped piece 2 located at the lower position among the plurality of combtooth-shaped pieces 2 which constitute the top portion 51 is pressed upward and pushes the combtooth-shaped piece 2 located at the opposed position upward as illustrated in FIG. 18B. The combtooth-shaped pieces 2 located on both sides are pushed out to the left and right. In this manner, the hemispherical shape is deformed.

Unlike the case illustrated in FIGS. 18A and 18B, FIG. 19 illustrates a deformed state of the writing portion 5 when the pressure is applied to the top portion 51 of the nib 1 under a condition in which the pen is directed to the paper sheet with the ink feed path 6 which is a boundary of two combtooth-shaped pieces 2 at the tip of the nib 1 facing immediately below is illustrated. In this case, if the hemispherical top portion 51 is seen from the front, the tips of the two combtooth-shaped pieces 2 located at the lower position of the pen among the plurality of combtooth-shaped pieces 2 which constitute the top portion 51 are pressed upward with the writing pressure and these two combtooth-shaped pieces 2 cooperatively push a single combtooth-shaped piece 2 located at an opposite position upward and, at the same time, push the combtooth-shaped pieces 2 located on both sides to the left and right. In this manner, the hemispherical shape is deformed. Other operations or behaviors are the same as those described above. Although the area A, illustrated by diagonal lines in FIG. 17, in which the nib touches the paper sheet is not illustrated in FIG. 19, the contact area A appears during writing also in the writing tip 5 in FIG. 19 like that illustrated in FIG. 17.

According to the second embodiment, since the nib 1 is formed by a plurality of separately provided combtooth-shaped pieces 2 which are assembled using the holder member 3 and the converging member 4, the shape of the parts can be simplified. It is therefore possible to perform a high yield mass production process with no precision error in dimension and position. In the machining process, the beveling operation of each part of the outside surface of the tip can be performed easily. Therefore, inexpensive products can be supplied in large quantities.

One ends of the five to eight combtooth-shaped pieces 2 are fixed to the holder member 3 and the converging member 4 is fit onto these combtooth-shaped pieces 2. In this manner, the converging member 4 applies averaged pressure to the five to eight combtooth-shaped pieces 2 to form a non-deformed conical shape. The hemispherical writing tip 5 which is not displaced at tip thereof is formed and certain ink feed paths 6 are formed between adjacent combtooth-shaped pieces 2. When the hemispherical writing tip 5 is pressed against the paper sheet at a certain angle with the shaft center, the hemispherical split portions 21 of the combtooth-shaped pieces 2 shift and elastically deform with respect to one another so as to increase an outer diameter of the hemispherical tip. When the pressing operation against the paper sheet is released, the tip elastically restores its original hemispherical shape. The thus-configured nib can be used to write in any directions on the paper sheet. The nib can be used in writing from any positions and from any angles, even if the pen is rotated about the pen shaft. In addition to that, the width of lines can be changed by varying intensity of writing pressure: therefore, characters of various features, e.g., brush-characters, such as characters of thick lines and thin lines, can be written. In accordance with the writing pressure, the combtooth-shaped pieces 2 deform and absorb the writing pressure. This cushioning effect provides a soft pen touch to fingers of the writer so that the writer will not easily get tired after long hours of writing. The cushioning effect reduces deformation or wear of the nib if the writing pressure is large and thus improves durability of the writing portion. Even if the pen is left unused for a long time or the moisture on a surface of the nib evaporates and the narrow gaps at the tip of the nib is clogged with dried ink, restarting of a writing action causes the writing tip 5 to move and the hemispherical portions are deformed. The narrow gaps are then deformed to break dried ink film or block and then the ink can be easily taken out again.

If, in this second embodiment, the conical portion of the nib is formed by, for example, four or less combtooth-shaped pieces 2, instead of five to eight combtooth-shaped pieces 2, and the number of splits of the hemisphere-shaped writing tip 5 is reduced, the distance between adjacent combtooth-shaped pieces 2 which functions as an ink feed path 6 becomes large with respect to an outer diameter of the tip. When the nib 1 is made to be in contact with the paper sheet, there is a possibility that the distance between the paper sheet and the groove becomes large depending on the angle. Then, a portion which introduces the ink in capillary action is separated from the paper sheet and the writing with ink becomes less smooth. In that case, it is necessary to limit the angle of the nib with respect to the paper sheet to some extent. An object of the nib of the present invention is to provide smooth and pleasant feeling in writing in a wide writing range of, for example, 90 to 45 degrees in any directions of the pen shaft without limiting the angle with respect to the paper sheet as much as possible. If the angle of the nib with respect to the paper sheet is limited to some extent, even if the number of splits of the conical tip is set to four or less, e.g., three, the same operation and effect can be produced as long as the same structure is provided, the hemisphere portions of the tip is displaced from each other, and the hemisphere portions are slightly increased in size by the increase and decrease in writing pressure.

Also in this second embodiment, it is desirable that the holder member 3 is manufactured by molding a general-purpose plastic material while the combtooth-shaped pieces 2 are made of engineering plastic. With such a configuration, even if the combtooth-shaped pieces 2 made of engineering plastic are very hard and lack flexibility during writing, since the holder member 3 which is a base portion of the combtooth-shaped pieces 2 is made of the plastic material of which hardness is lower than that of engineering plastic, the combtooth-shaped pieces 2 are supported by the holder member 3 which is highly elastic. Therefore, a higher degree of elasticity is provided to the combtooth-shaped pieces 2.

Although the invention has been described with reference to the preferred embodiments illustrated in the drawings, it is understood by those skilled in the art that various changes and modifications can be made without departing from the spirit and scope of the invention. The invention includes those modifications.

What is claimed is:

1. A conical nib which is fixed to a tip of a pen shaft including an ink reservoir and is connected to the ink reservoir via an ink supply wick having a capillary action, the nib comprising: a holder member formed in a tubular shape; and a plurality of combtooth-shaped pieces provided at one end side of the holder member, the plurality of combtooth-shaped pieces being shaped to form a substantially hemispherical tip and being converged gradually toward the tip in a substantially conical shape, the nib being formed in a conical shape including a writing tip at a tip thereof and ink feed paths formed between adjacent combtooth-shaped pieces, wherein the nib is made of a synthetic resin material in which engineering plastic, among other plastic, is used.

2. The conical nib according to claim 1, wherein the plastic used as a material of the nib is a polymer blend or a polymer alloy selected from at least two kinds of general-purpose plastic and engineering plastic.

3. The conical nib according to claim 1, wherein the plastic corresponding to the engineering plastic used as the material of the nib is polyoxymethylene (POM), polyphenylene ether (PPE), polycarbonate (PC), polybutadiene terephthalate (PBT), polyamide (PA) or at least one of plastic materials similar thereto.

4. The conical nib according to claim 1, wherein the nib may further be made of super engineering plastic and the plastic corresponding to the super engineering plastic is polyphenylenesulfide (PPS), polyethersulfone (PES), polyetheretherketone (PEEK), polyarylate (PAR), polysulfone (PSF), polyetherimide (PEI), or at least one of plastic materials similar thereto.

5. A writing instrument, comprising: a pen shaft which has an ink reservoir containing ink; and a nib which is fixed to a tip of the pen shaft and is connected to the ink reservoir via an ink supply wick having a capillary action, in which: the nib including a holder member formed in a tubular shape and a plurality of combtooth-shaped pieces provided at one end side of the holder member, the plurality of combtooth-shaped pieces being shaped to form a substantially hemispherical tip and being converged, gradually toward the tip in a substantially conical shape; the nib being formed in a conical shape including the writing tip at a tip thereof and ink feed paths defined between adjacent combtooth-shaped pieces; and the ink supply wick being inserted in a hollow portion of the nib, wherein the nib is made of a synthetic resin material in which engineering plastic, among other plastic, is used.

6. The conical nib according to claim 1, wherein a colorant is added to the nib to change a color rendering property of the nib.

* * * * *